US006270391B1

(12) United States Patent
Emilsson

(10) Patent No.: US 6,270,391 B1
(45) Date of Patent: Aug. 7, 2001

(54) LIGHTING SYSTEM FOR ROTATING OBJECT

(76) Inventor: Tryggvi Emilsson, 1404 S. Grove St., Urbana, IL (US) 61801

( * ) Notice: Subject to any disclaimer, the term of this patent is extended or adjusted under 35 U.S.C. 154(b) by 0 days.

(21) Appl. No.: 09/244,551

(22) Filed: Feb. 2, 1999

(51) Int. Cl.[7] ..... A63H 27/00; A63H 1/30

(52) U.S. Cl. ..... 446/47; 446/129; 446/242; 446/250; 446/485; 315/200 A

(58) Field of Search ..... 446/47, 129, 130, 446/236, 242, 250, 484, 485; 315/200 A, 210, 161

(56) References Cited

U.S. PATENT DOCUMENTS 3,662,255 * 5/1972 Garrett .
4,114,305 * 9/1978 Wohlert et al. .
5,317,238 * 5/1994 Schaedel ..... 315/323

* cited by examiner

*Primary Examiner*—Jacob K. Ackun, Jr.
*Assistant Examiner*—Jeffrey D. Carlson
(74) *Attorney, Agent, or Firm*—Dennis H. Rainear

(57) ABSTRACT

This invention relates to a lighting system for a rotating object wherein the lights are made to appear stationary by being turned on and off in synchrony with the rotation of the object. This synchronization is achieved by utilizing magnetic field sensors which determine the instantaneous orientation of the object relative to the Earth's magnetic field.

8 Claims, 3 Drawing Sheets

LIGHTING SYSTEM FOR ROTATING OBJECT

FIELD AND BACKGROUND OF THE INVENTION

This invention relates generally to lighting systems for rotating objects, and in particular to a flashing light system for a so-called "flying saucer" toy.

The well known flying saucer toy is simply a light-weight disc having aerodynamic characteristics enabling it to travel considerable distances when thrown and which spins during flight. A common tradename for such a device is the "FRISBEE" type flying disc. Prior art flying disc toys have been enhanced with lights mounted thereon to add interest and entertainment. Typical of such flying disc lighted toys are those disclosed in U.S. Pat. No. 3,786,246 utilizing chemiluminescence or the battery powered flashing light system described in U.S. Pat. No. 3,812,614.

Later systems used light emitting diodes (LEDs) as a light source, powered by small low voltage batteries. A few flying discs have provided circuitry to apply a square wave or similar cyclic voltage to the LEDs. This type of circuitry has included timer circuits and oscillators formed from NOR or NAND gates. Unfortunately, the regular pulsations of the LED light sources are not in any way controllable by the user. Moreover, the LEDs must be turned on prior to use, and off after use.

Some attempts have been made to provide a flying disc toy with an on-board switch that turns power on only when the disc is in use. Such switches have included centrifugally-activated electrical switches. Although the above-described lighted flying disc toys are workable, they still present some shortcomings. The chemiluminescence system has the basic disadvantage that once actuated it cannot be deactivated and hence simply stays on until exhausted. The battery powered systems either produce lights that stay on continuously in flight, or that flash at some fixed rate which is not related to the speed of rotation of the toy.

It is therefore desirable to have a lighting system for a rotating object, such as, but not limited to, a flying disc toy in which the lighting pattern is made to flash in exact synchrony with the rotation, thus making the lighting pattern appear stationary (i.e. non-rotating) to an observer.

SUMMARY OF THE INVENTION

It is the primary purpose of the present invention to provide a system of flashing lights for a rotating object wherein the timing of the lights is controlled by signals derived from transducers which are responsive to the instantaneous orientation of any magnetic field, such as but not limited to the flux of the Earth's magnetic field through the object.

The present invention is directed to a novel object or flying disc toy comprising LED lighting which flashes in response to rotation of the object or disc in the Earth's magnetic field.

DESCRIPTION OF PREFERRED EMBODIMENTS

Figure 1:
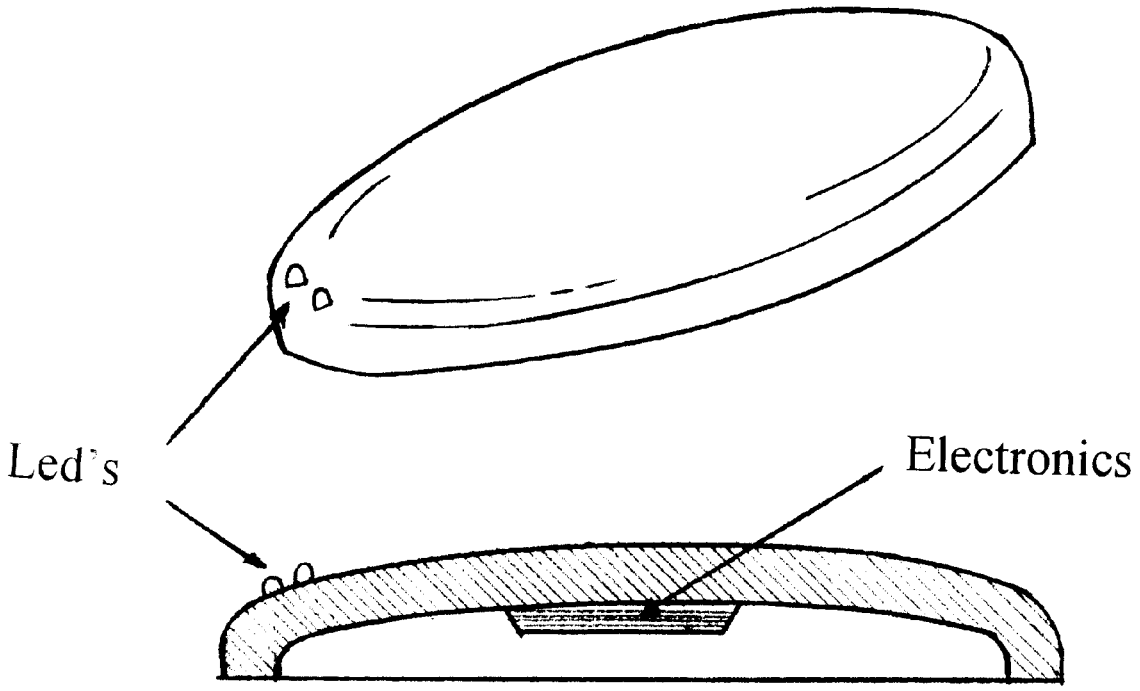
FIG. 1 is a perspective view of a flying disc toy embodying the invention.

In one embodiment of the present invention is presented a flying object or saucer disk toy, such as a "FRISBEE" brand toy, in which a lighting system is provided wherein the lights blink on and off in exact synchrony with the rotation of the disk. By "disk", "disc" or "object" herein is meant both solid and ring-shaped articles. The timing of the light blinking is controlled by a sensor means which determines the angular orientation of the disk object relative to any, or the Earth's, magnetic field. In this embodiment of the invention, the sensor means can be, for example, a thin bar of magnetically "soft" iron wound with many turns of thin insulated copper wire which forms a coil. One example would be a thin bar of soft iron, 3 inches long and ⅛ inch thick, wound with approximately 1500 to 2000 turns of insulated copper wire. When the object spins, the Earth's magnetic field induces a voltage in said coil, according to Faraday's Law of induction. The voltage induced in the coil is typically between a few millivolts and a tenth a volt. This signal is led to an operational amplifier which controls LED's, which are thus turned on and off in synchrony with the rotation of the object.

Thus, one embodiment of the present invention provides a body member which comprises a substantially disc shaped body terminating at its periphery in a downwardly extending rim, whereby the body and the rim define a substantially convex upper surface and a substantially concave lower surface.

In another embodiment of the present invention, a flying disc toy is equipped with a magnetic field sensor which uses the Earth's magnetic field to produce a timing signal, which in turn can be used to turn the lights on and off. Thus, as the flying disc toy flies spinning through the air, lights can be made to turn on and off with each revolution, thereby providing a pattern of lighting that appears to be stationary, or non-rotating.

In another embodiment, a plurality of magnetic field sensor means positioned on or within the perimeter of the rotating object or disk at different angles can be used, thus providing timing signals of various phase angles for the generation of more intricate and entertaining light patterns. Further, the rotatable object of the present invention can further comprise an electronic circuitry whereby the movement of the body member through a magnetic field lines actuates the magnetic field sensor to emit an electrical signal which causes one or more light emitting devices or liquid crystal devices to turn on.

The magnetic field sensor useful in the present invention is based on Faraday's law, which states E=n dQ/dt, where E is the potential developed in a coil with n turns and Q is the magnetic flux through the coil. The flux Q is the integral of the magnetic field B over the area of the coil. Since the magnetic field can be considered homogeneous, this integral can be calculated as Q=(H)(u)(a)sin(theta), where B=Hu and where a is the area of the coil, H is the Earth's magnetic field, u is the magnetic permeability of the coil's core material and theta is the angle between the axis of the core and the Earth's field. If the flying disc toy, such as the Frisbee brand toy, rotates with an angular velocity omega, then the induced voltage can be expressed as $$E=u\times n\times H\times a\times d(\sin \text{omega}(t))/\text{dt where omega}(t)=\text{theta}.$$

In one example of the present invention and not as a limitation, a Frisbee brand toy spins about ten times per second when thrown, so omega=10×2×(3.14), or about 60 radians per second. The Earth's magnetic field is about 0.5 Gauss, or 0.00005 Tesla. The permeability of the iron core used in one example of the present invention is about 5000 and the coil has about 1000 turns and an area of 2 square millimeters, or about 0.000002 $m^2$.

Thus, $$E=5000\times1000\times0.00005\times0.000002\times d(\sin(60t))/dt$$

$$E=0.0005\times60\times\cos(60t)=0.03\text{ volts}\times\cos(60t)$$

This calculation illustrates the voltage expected from the coil, spinning at 10 revolutions per second in the Earth's magnetic field.

Ordinarily, this voltage is not sufficient to drive an LED sufficient for visual perception. Since the resistance of the coil is about 20 ohms, the power available to an external load is on the order of 20 microwatts. A higher voltage can therefore be obtained by increasing the diameter of the core, or increasing the permeability of the core, or increasing the number of turns in the coil.

In certain embodiments of the present invention, it might not be feasible to get enough power out of the coil to drive the LEDs directly. In such situations, according to the present invention, an amplifier can be utilized to increase the power to a sufficient level. Thirty millivolts, for example, is often enough to drive the cheapest operational amplifier to saturation. Very thin insulated wire may be used in the coil since the input impedance of typical operational amplifiers is many mega ohms.

FIG. 1 illustrates one embodiment of a device of the present invention. Other shapes and modifications readily recognizable to those skilled in the art are also within the scope of the present invention.

Figure 2:
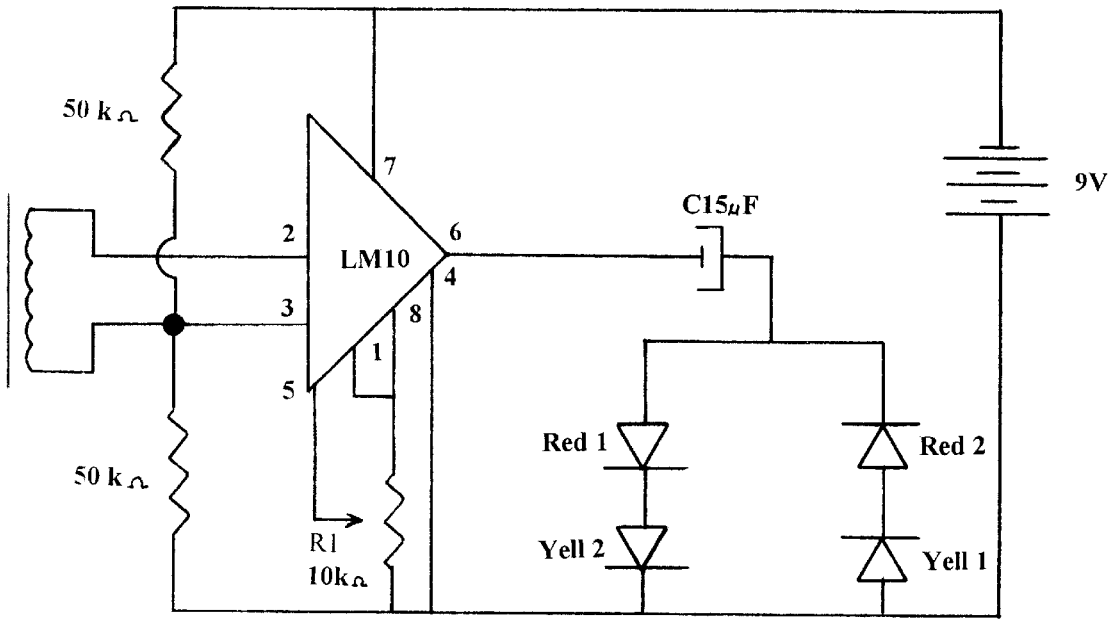
FIG. 2 is a schematic diagram of the components of a flying disc toy embodying the invention.
Figure 3:
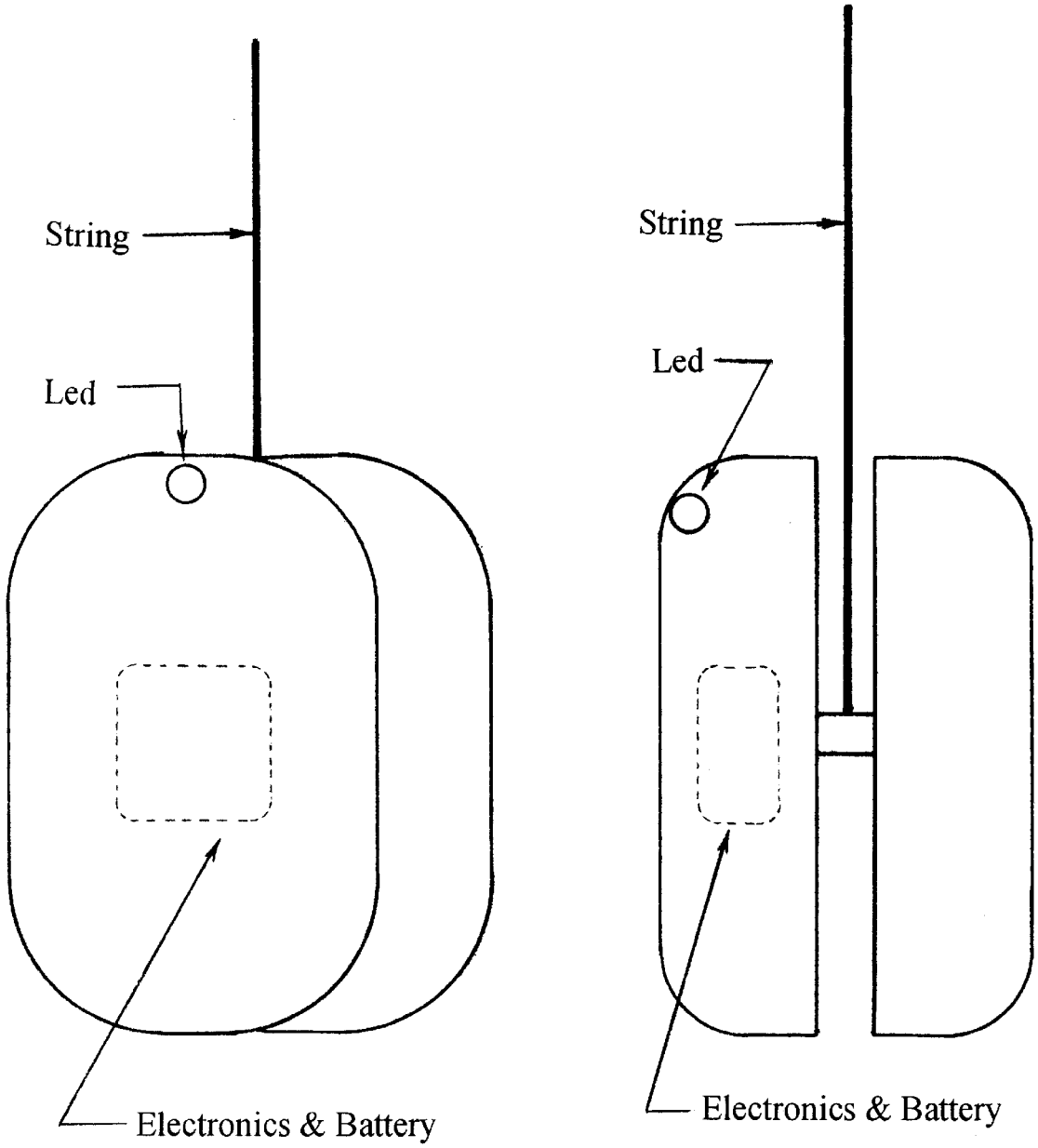
FIG. 3 is a perspective view of a Yo-Yo type toy.

FIG. 2 is a diagram of an electrical circuit representative of one embodiment of the present invention. The operational amplifier can be, for example but not by limitation, a National Semiconductor LM10, although those skilled in the art will readily recognize the interchangeability of equivalent amplifiers. This particular type of operational amplifier is preferred because it does not require a balanced power supply and it works with any voltage from about 1.1 volts to about 40 volts. In addition, preferred amplifiers have an internal reference and a second low power operational amplifier on the chip, so that with the addition of an external variable resistor (R1), it is easy to balance the input offset. The operational amplifiers specifications state that the maximum input offset is 2 millivolts. As long as the output from the sensor is substantially higher than 2 millivolts, such as for example, 30 millivolts, it is not necessary to balance the offset. As a result, a simple operational amplifier will work effectively. The only condition is that the open-loop gain be sufficient to drive the amplifier to the limits of the supply voltage. Most commercial operational amplifiers have open-loop voltage gains of 10,000 to 50,000, which is more than enough to be functional in the present invention.

According to the present invention, the power output can be coupled to the LEDs through capacitor C1 of 5 uF. One pair of LEDs can be set to turn on briefly just as the signal from the sensor coil crosses from positive to negative, and the other LEDs turn on as the sensor voltage crosses from negative to positive. When the object or toy is not spinning, none of the LEDs receives any power and the drain on the battery is quite low, or about 0.1 milliamp or less.

In the embodiment of the device and circuit of FIG. 1 and FIG. 2, the values of the components are not critical in the present invention. For example, the two components labeled "50 K" are preferrably 50 kilo ohm resistors, but could be anything, as high as several mega ohms, as long as they are roughly equal to each other. (E.g.. they could both be 1 mega ohm +/−30%, or both 0.1 mega ohm +/−30%).

The component labeled "R1 10 K ohm" is preferably a potentiometer. It could have any value from 5 to 200 K ohms. In many embodiments it could be omitted altogether since there is no real need to "balance" the input of the op-amp.

The component labeled "C1 5 uF" is an electrolytic capacitor. It's value is roughly matched to the maximum current output capability of the particular op-amp used, and the current draw of the LEDs. The LEDs (labeled "Red1", "Red2", "Yell1" and "Yell2") are for example, those commercially available such as Radio Shack brand "high intensity" LEDs. If C1 is made smaller, the light flashes of the device according to the present invention get "crisper", but look dimmer. The maximum light output from this circuit is limited by the current output of the op-amp. Brighter flashes can be obtained by boosting the output of the op-amp with the addition of transistors. Endless variations will be apparent to those practitioners skilled in the art.

According to the present invention, circuits are provided that produce bright and crisp flashes while the disc is spinning through the Earth's magnetic field lines, whereby intricate and fascinating light patterns are achieved.

In another embodiment of the present invention, a circuit is presented which consumes so little current while it is not flashing that an on/off switch would be unnecessary.

A key feature of the present invention is the ability to synchronize the flashing or blinking of lights on a spinning or rotating object to the object's rotation rate, whereby as seen from the stationary viewer's position, the lights seem to be stationary regardless of the rate of rotation of the spinning object.

In yet another embodiment, a centrally located light source can be added which could be steady or flashing for a minute after the toy has stopped spinning. In this manner, the toy would be easier to find when it gets thrown to dark places, like bushes or under parked cars, etc.

According to the present invention, small lights, such as xenon strobe lights, can also be mounted on the spinning object which are bright enough to be visible in full sunlight. Such light sources can include, for example, flash bulbs such as those used in disposable cameras.

Another embodiment of this invention uses liquid crystal displays (LCD's) for a disk or toy usable in daylight. In yet another embodiment, a liquid crystal display would be driven directly by the output of a coil, without an amplifier or batteries. This embodiment of the present invention is feasible and practical because of the extremely low current requirements of LCD's.

The present invention is also directed to spinning objects other than flying disc toys. Thus, for example, yo-yo's and tops, hub cap ornaments can also be illuminated by the magnetic field sensor technique of the present invention. Therefore, for example, the present invention presents a toy comprising:

(a) two substantially round parts connected along their centerlines by a short thin shaft so that a gap remains between the parallel surfaces of the two round parts, commonly known as a "Yo-Yo";

(b) a string loosely attached to the shaft that can be wound up in the gap between the two round parts, and used to impart a rotary motion on the toy;

(c) at least one electronically-powered lighting means supported by one or both of the round parts, and operative for producing a distinctive light signal when actuated;

(d) a battery supported by the round parts, and operative for supplying electrical power for the lighting means; and (e) a magnetic field sensor means which senses the rotation of the toy in or through the Earth's magnetic field lines and thereby actuates the lighting means.

A number of other circuits and sensor known to those skilled in the art can be used in various embodiments of the present invention and all such circuits and sensors are intended to be included within the scope of legal equivalents. For example, so-called flux-gate sensors, Hall effect sensors, magneto-resistive sensors are also operative herein.

Thus, in one embodiment of the present invention is provided a substantially disc shaped body terminating at its periphery in a downwardly extending rim. The body and the rim define a substantially convex upper surface and a substantially concave lower surface. The disc shaped body is equipped with at least one and preferably a plurality of LEDs, mounted at spaced intervals about the annular sidewall of the periphery of the disc shaped body, and/or about a raised center section of the disc shaped body. The electronic circuitry for a power source, the LEDs, and magnetic field sensor can be housed in the interior cavity on the upper convex surface of the body or under the concave surface of the body.

In another embodiment, the present invention presents a disc shaped body having a downturned peripheral flange, said body adapted to be propelled through the air in free flight and concurrently rotated during at least a portion of said flight at a predetermined rate. This disc shaped body is equipped with diametrically opposed LEDs and control means connected to said LEDs, said control means being operable to turn said LEDs off and on at a frequency which is approximately a whole number multiple of said rotation rate. In this manner is produced an apparent non-rotating stroboscopic effect for a viewer of said disc shaped body. The control means comprises a magnetic field sensor or field sensor means which can detect the magnetic field lines, such as the Earth's magnetic field lines, and generate a signal as the disc shaped body travels across or through said magnetic field lines.

Thus, the present invention broadly relates to a rotatable object comprising a) a body member having a central axis about which said member is adapted to rotate, (b) at least one light emitting device, (c) a power source, and (d) a magnetic field sensor able to emit an electrical signal responsive to movement of the body member through a magnetic field.

The invention also provides a disc shaped aerial toy comprising:

(a) a disc shaped body member having a central axis about which the body member spins in a sustained flight when the body member is hurled into the air, (b) at least one actuatable, electronically-powered lighting means supported by the body member, and operative for producing a distinctive light signal when actuated;

(c) a power source such as a battery supported by the body member, and operative for Supplying electrical power for the lighting means; and (d) a magnetic field sensor means which senses the movement of the body member through a magnetic field, such as the Earth's magnetic field lines and which thereby actuates the lighting means. In a preferred embodiment, there is a plurality of lighting means which are LEDs, and these LEDs turn off and on at a rate which is approximately a whole number multiple of the rate of spin of the body member when hurled through the air.

The invention is not limited to the specific features described herein, since the means described herein comprise preferred forms of putting the invention into effect. The invention is therefore to be interpreted in accordance with the doctrine of equivalents.

That which is claimed is:

1. A rotatable object comprising (a) a body member having a central axis about which said member is adapted to rotate, (b) at least one light emitting device, (c) a power source to power said light emitting device, and (d) a means for sensing a magnetic field and delivering an electrical signal, causing power to be delivered to said light emitting device only when the object is moving through said magnetic field, and wherein said signal is independent of the proximity of a metal object to the sensor.

2. The rotatable object of claim 1 wherein the body member comprises a substantially disc shaped body terminating at its periphery in a downwardly extending rim, whereby the body and the rim define a substantially convex upper surface and a substantially concave lower surface.

3. The rotatable object of claim 1 wherein said sensor is a core wound with an electrical conductor.

4. The rotatable object of claim 1 further comprising an electronic circuitry whereby the movement of the body member through a magnetic field actuates the magnetic field sensor to emit an electrical signal which causes said at least one light emitting device to turn on.

5. The rotatable object of claim 1 further comprising an operational amplifier capable of amplifying the signal emitted by the magnetic field sensor.

6. The object of claim 1 wherein the magnetic field is the Earth's magnetic field.

7. A disc shaped aerial toy comprising:

(a) a disc shaped body member having a central axis about which the body member spins in a sustained flight when the body member is hurled into the air, (b) at least one electronically-powered lighting means supported by the body member, and operative for producing a distinctive light signal when actuated;

(c) a battery supported by the body member, and operative for supplying electrical power for the lighting means; and (d) a magnetic field sensor means for sensing the movement of the body member through the Earth's magnetic field lines, and delivering an electrical signal, causing power to be delivered to said lighting means.

8. A toy comprising:

(a) two substantially round parts each having a planar surface the two planar surfaces being parallel and connected along their centerlines by a short thin shaft so that a gap remains between the parallel surfaces;

(b) a string loosely attached to the shaft that can be wound up in the gap between the two planar surfaces, and used to impart a rotary motion on the toy;

(c) at least one electronically-powered lighting means supported by one or both of the round parts, and operative for producing a distinctive light signal when actuated;

(d) a battery supported by the round parts, and operative for supplying electrical power for the lighting means; and (e) a means for sensing movement of the toy in or through the Earth's magnetic field and delivering an electrical signal, causing the power to be delivered to the lighting means.

* * * * *